US008672038B2

(12) United States Patent
Tan et al.

(10) Patent No.: US 8,672,038 B2
(45) Date of Patent: Mar. 18, 2014

(54) RETRIEVABLE SUBSEA BRIDGE TREE ASSEMBLY AND METHOD

(75) Inventors: Hoon Kiang Tan, Singapore (SG); Kim Kok Goi, Singapore (SG); Patrick Joseph Hyde, Singapore (SG); Peter Ernest Page, East Perth (AU)

(73) Assignee: Magnum Subsea Systems PTE Ltd., Singapore (SG)

( * ) Notice: Subject to any disclaimer, the term of this patent is extended or adjusted under 35 U.S.C. 154(b) by 519 days.

(21) Appl. No.: 13/016,256

(22) Filed: Jan. 28, 2011

(65) Prior Publication Data

US 2011/0192609 A1 Aug. 11, 2011

Related U.S. Application Data

(60) Provisional application No. 61/303,052, filed on Feb. 10, 2010.

(51) Int. Cl.
*E21B 43/013* (2006.01)

(52) U.S. Cl.
USPC ..... 166/344; 166/338; 166/340; 166/368; 166/97.1; 285/134.1

(58) Field of Classification Search
USPC ..... 166/340, 338, 339, 344, 351, 360, 368, 166/378–380, 91.1, 95.1, 97.1; 285/134.1, 285/135.1; 138/95
See application file for complete search history.

(56) References Cited

U.S. PATENT DOCUMENTS

| | | | | |
|---|---|---|---|---|
| 4,161,367 | A | 7/1979 | Cuiper | |
| 5,195,589 | A * | 3/1993 | Mota et al. | 166/341 |
| 5,244,045 | A * | 9/1993 | Mota | 166/341 |
| 5,971,077 | A * | 10/1999 | Lilley | 166/368 |
| 6,357,529 | B1 * | 3/2002 | Kent et al. | 166/344 |
| 6,460,621 | B2 * | 10/2002 | Fenton et al. | 166/347 |
| 6,655,455 | B2 | 12/2003 | Bartlett | |
| 6,698,520 | B2 * | 3/2004 | Fenton et al. | 166/347 |
| 7,032,673 | B2 | 4/2006 | Dezen | |
| 7,331,396 | B2 * | 2/2008 | Reimert et al. | 166/368 |
| 7,565,931 | B2 * | 7/2009 | Saucier | 166/344 |
| 7,647,974 | B2 * | 1/2010 | Fenton | 166/368 |
| 7,992,633 | B2 * | 8/2011 | Donald et al. | 166/75.12 |
| 7,992,643 | B2 * | 8/2011 | Donald et al. | 166/339 |
| 8,011,436 | B2 * | 9/2011 | Christie et al. | 166/359 |
| 8,066,067 | B2 * | 11/2011 | Donald et al. | 166/267 |
| 8,091,630 | B2 * | 1/2012 | Donald et al. | 166/90.1 |
| 8,122,948 | B2 * | 2/2012 | Donald et al. | 166/75.12 |

(Continued)

FOREIGN PATENT DOCUMENTS

| | | |
|---|---|---|
| WO | WO 00/47864 A1 | 8/2000 |
| WO | WO 03/033868 A1 | 4/2003 |

*Primary Examiner* — Matthew Buck
(74) *Attorney, Agent, or Firm* — Kenneth L. Nash

(57) ABSTRACT

A retrievable bridge is provided which mounts to the top of a subsea tree to provide fluid communication between the production line of the subsea tree and a production flowline. The retrievable bridge mounts to the top of the subsea tree and preferably connects to a vertically oriented pipe of the production flowline. The retrievable bridge can be utilized to carry wear items such as chokes, subsea control modules, and flow meters which may require maintenance more often than other components of the subsea tree. By mounting these items along the flow passageway in the retrievable bridge the components are securely mounted and still available for maintenance/replacement without the need to remove the entire tree. In one embodiment, Intervention into the well is available without removing the retrievable bridge.

18 Claims, 14 Drawing Sheets

(56) References Cited

U.S. PATENT DOCUMENTS

| | | | | |
|---|---|---|---|---|
| 8,167,049 | B2 * | 5/2012 | Donald et al. | 166/368 |
| 8,220,535 | B2 * | 7/2012 | Donald et al. | 166/91.1 |
| 8,245,787 | B2 | 8/2012 | White | |
| 8,272,435 | B2 * | 9/2012 | Donald et al. | 166/95.1 |
| 8,281,864 | B2 * | 10/2012 | Donald et al. | 166/368 |
| 8,297,360 | B2 * | 10/2012 | Donald et al. | 166/364 |
| 2005/0109514 | A1 * | 5/2005 | White et al. | 166/368 |
| 2008/0277122 | A1 | 11/2008 | Tinnen | |
| 2008/0302535 | A1 | 12/2008 | Barnes | |
| 2009/0025936 | A1 | 1/2009 | Donald | |
| 2010/0018693 | A1 | 1/2010 | Duncan | |

* cited by examiner

RETRIEVABLE SUBSEA BRIDGE TREE ASSEMBLY AND METHOD

This application claims benefit of U.S. Provisional Application No. 61/303,052, filed Feb. 10, 2010.

FIELD OF THE INVENTION

The present invention relates generally to subsea trees and, more particularly, to a bridge subsea tree with a retrievable bridge which connects the production line bore to the production flowline, and provides connections to annulus lines or fluid injection line.

BACKGROUND OF THE INVENTION

Prior art subsea trees are installed on a wellhead with an annulus line and a production line. Prior art subsea trees provide a lateral connection which extends from the side of the subsea tree and provides a production flowline on the subsea tree prior to the subsea tree being lowered to the sea bed and installed. In many cases, the lateral connection also houses a choke. The rest of the production flowline typically runs along the sea bed where it may eventually be connected to a distribution manifold, a tanker or a surface facility.

The lateral connection between the production line and the production flowline, with all the accessory items, is secured to the subsea tree. If it is desirable to change the configuration or to replace or maintain certain of the accessory items such as the choke or other accessories, the entire subsea tree will need to be retrieved. Thus, changes to a subsea configuration will generally involve substantial and rather costly operations due to the cost of removing the subsea tree. To the extent high wear items are provided, such as chokes and/or other high wear items, it is expensive to remove the entire tree to replace a wear item. In some cases, removable chokes and choke inserts may be utilized to avoid the costs of removing the entire tree but removable chokes and/or other removable accessories each then require special mounting equipment and connections, such as retrievable Subsea Control Modules and retrievable choke inserts.

Referring to FIG. 1, there is shown a schematic configuration of a typical prior art subsea well 10 comprising subsea tree 40 mounted on wellhead 12. Subsea tree 40 comprises an annulus line 14 and a production line 16. At the side of subsea tree 40, a fixed lateral connection 18 goes through valve 20, which may be a production wing valve. Fixed lateral connection 18 then leads to production flowline 22. Production line 16 may comprise production service valve and production master valve 24. The production of the well flows from production line 16 into production flowline 22. The fixed lateral connection 18 may also comprise a choke, which creates back pressure and provides a desired flow rate. Access to the well bore from a surface rig may be provided through production line 16. Annulus line 14 may comprise annulus service valve 26, annulus master valve 28, and other annulus access valves, as indicated at 30, which are utilized to access the annulus of the well. Additional barriers from downhole valves 32 or plugs may be utilized in wellhead 12 to shut in the well for replacement of tree 40, and the like. Connection 34 schematically represents the physical connection of subsea tree 40 to wellhead 12, and may take the form of various types of connectors, which may be operated hydraulically or mechanically and/or fitted using remotely operated vehicles.

The following patents disclose prior art attempts to solve the above discussed problems.

U.S. Patent Publication No. 2005/0109514, published May 26, 2005, to White et al, discloses a subsea production tree that has an external annular profile formed on an upper portion of the tree. A vertical passage extending from a lower end of the tree to an upper end of the tree for communicating with a string of tubing extending into the well. A lateral passage in the tree extending from the vertical passage. A flow path in fluid communication with the lateral passage extends laterally from the tree, the flow path having an upward facing receptacle. An adapter lands on the upper portion of the tree and connects to the profile, the adapter having a passage that registers with the vertical passage of the tree while the adapter lands on the tree. A flow interface device mounts to and lands with the adapter, the flow interface device having an inlet conduit and an outlet conduit, one of the conduits being connected to the passage in the adapter, the other of the conduits stabbing into sealing engagement with the receptacle as the adapter lands on the tree.

U.S. Patent Publication No. 2009/0025936, published Jan. 29, 2009, to Donald et al, discloses a connection system for connecting flow interface equipment to a subsea manifold. The connection system relates particularly to a connection apparatus adapted to land a conduit means on a subsea manifold in a first stage of the connection and to connect a conduit means of the connection apparatus to a choke body of the manifold in a second stage of the connection.

U.S. Patent Publication No. 2008/0302535, published Dec. 11, 2008, to Barnes, discloses a multi-component system for subsea intervention. The system comprises a lower riser component which is held vertical by a buoyancy element and an upper riser system. The upper riser system is a continuous, enjoined conduit with sufficient flexibility to absorb the motion of the deployment vessel without adversely affecting the function of the intervention system.

U.S. Patent Publication No. 2008/0277122, published Nov. 13, 2008, to Tinnen, discloses an apparatus and a method for subsea deployment and/or intervention through a wellhead of a petroleum well. The apparatus comprises a first module integrated in a portion of a subsea well intervention system assembly and/or a subsea production system assembly, the first module comprising an intervention tool bore; a second module comprising a tubular element initially housing an intervention tool, wherein the second module being arranged for sliding into releasable engagement with the intervention tool bore of the first module, whereupon the intervention tool is arranged for disengagement from the tubular element for deployment of the intervention tool into the wellbore.

U.S. Pat. No. 6,655,455, issued Dec. 2, 2003, to Bartlett et al, discloses a flow completion system for controlling the flow of fluid from a well bore, the flow completion system comprising a tubing spool, a tubing hanger supporting a tubing string which extends into the well bore and defines a tubing annulus surrounding the tubing string; a first closure member which is positioned in the production bore above the production passageway; a first annular seal wherein the first closure member and the first seal comprise a first pressure-containing barrier between the well bore and a surrounding environment; a second closure member which is positioned in the production bore above the first closure member; and a second annular seal wherein the second closure member and the second seal comprise a second pressure-containing barrier between the well bore and the environment; and wherein both the first and the second barriers are associated with the tubing hanger.

U.S. Pat. No. 7,032,673, issued Apr. 25, 2006, to Dezen et al, discloses an outer wellhead housing has an external locator member initially oriented in a desired direction. An inner wellhead housing lands in the outer wellhead housing. A BOP orientation spool with an external orientation member and an internal orientation member lands on the inner wellhead housing and orients via the external locator member. A tubing hanger with an orientation member and associated tubing hanger running tool with another orientation member lower through the BOP orientation spool and orient as they land in the inner wellhead housing. A production tree with an orientation member on a lower end lands on the inner wellhead housing. The orientation member of the production tree engages the orientation member of the tubing hanger to rotate the tree to a desired orientation.

U.S. Patent Publication No. 2010/0018693, published Jan. 28, 2010, to Duncan et al, discloses an apparatus for inserting coiled tubing into a sub-sea pipeline comprising an adaptor which is releasably coupled to an anchor to hold the adaptor in position against lateral and/or vertical forces, the adaptor having: i) a first end comprising first coupling means for releasably coupling the adaptor to a riser and an opening through which coiled tubing can extend, ii) a second end comprising second coupling means for releasably coupling the adaptor to the anchor, and iii) a curved guide comprising an entrance end facing the opening and an exit end, the curved guide being in communication with the opening such that coiled tubing from the riser can extend through the opening and along the curved guide, the curved guide, in use, guiding the coiled tubing from a substantially vertical orientation at the entrance end to a substantially horizontal or near-horizontal orientation at the exit end.

U.S. Pat. No. 4,161,367, issued Jul. 17, 1979, to Cuiper et al, discloses a diverless subsea flowline connection system that includes connectors for remotely connecting the ends of a first bundle of flowlines to the ends of a second bundle of flowlines and guidance components which direct the end portions of the first bundle of flowlines into precise connecting alignment with the end portions of the second bundle of flowlines without damage to the connecting seals. The ends of the first bundle are covered and sealed so that the flowlines can be pulled across the seafloor without damage to the ends of the flowlines. Means are provided for pulling the first bundle toward an alignment structure so that the lines can approach the structure from a wide variety of angles and the structure will guide the first bundle into exact alignment with the second bundle. This pulling means includes means for connecting a pulling cable to the radial center of a pulling head attached to the ends of the first bundle of flowlines. The ends of the flowlines are connected together and aligned before the fluid-tight seals are set to prevent possible damage to the seals. After the flowline ends are precisely aligned the seals are set. If desired, the connecting seals can be replaced by remote control. The pulling, aligning, replacement of seals and fluid-tight connecting of the flowlines is all done by remote control from the surface of the sea.

The above listed prior art efforts do not solve the above discussed problems. Consequently, those of skill in the art will appreciate the present invention which is directed to reduce the significant cost created by the above prior art limitations.

SUMMARY OF THE INVENTION

Accordingly, in accord with one possible embodiment of the invention a subsea retrievable bridge tree is provided. The subsea retrievable bridge tree is built differently than prior art subsea trees, which provide more or less permanent configurations of production flow equipment which are not easily removable or modified. In the prior art, a horizontal portion of the production flowline connects to the side of the subsea tree, forming an integral assembly. In one embodiment of the present invention, a replaceble bridge is provided that connects at the top of the subsea tree and to the top of a vertical portion of the production flow line. The bridge comprises an internal flow path that provides fluid communication between the production line wellbore and the production flowline. The replaceable bridge can be retrieved without the need for retrieval of the tree. The retrieved bridge can also be replaced by a reconfigured new bridge assembly to suit change in requirements.

Thus, in one embodiment, the present invention provides a subsea tree with a vertical production line therein, a vertical portion of a production flowline, and a replaceable bridge connectable to an upper end of the vertical production line and to an upper end of the outboard vertical portion of the production flowline on the subsea tree. This feature of connection may also apply to the annulus line which may be used for monitoring or injection.

The replaceable bridge may be configured with components that are most likely to need replacement or maintenance. In this case, servicing the wear components merely requires replacing the retrievable bridge rather than replacing the entire subsea tree. The replaceable bridge may be provided with components in different configurations to suit different needs. For example, a well may be changed from a production well to an injection well without removing the tree. The replaceable bridge may house a choke (production or injection), flowmeters, sand detectors, subsea control modules, chemical injection metering valves, processing equipment, etc. in different combinations and configurations. The design embodiment allows the operator to alter the configuration of the subsea tree, at a different stage of the field life, by replacing the retrievable bridge with one configured for the new requirements. For example, the replaceable bridge may also be configured with a gas injection choke or choke which is reversed for gas injection into the production line. Thus, the configuration of the subsea tree can be changed without removing the tree.

The replaceable bridge defines therein a fluid flow passageway and/or other components. The replaceable bridge comprises connectors for connecting to the top of the vertical production line and for connecting to the top of the production flowline. The connectors may be hydraulically activated or manually activated by a diver or underwater remotely operated vehicle.

In another embodiment, an intervention method through the replaceable bridge is provided. The method may comprise steps such as running an intervention package for connecting to the replaceable bridge via an intervention connector on the replaceable bridge. The intervention connector may be a pin or box type connector. The bottom end of the intervention connector is then connected to the top of the replaceable bridge with a barrier between the connector and the bridge, for pressure control. This barrier may be a crown valve or an internal retrievable plug. The crown valve on the intervention connector is opened (or the internal plug is retrieved) whereupon workover or intervention activities can proceed into the well through the intervention connector and the replaceable bridge (and the intervention package). The intervention connector allows make up to any intervention tooling or equipment for the purposes of running some equipment into the well, via the bridge assembly and the tree. The crown valve in the intervention connector (or the internal retrievable plug) provides pressure control on the retrievable bridge assembly and is opened for access to tree and well. After the intervention activity, the crown valve is closed again (or the internal retrievable plug is installed) before removal of the intervention package or other accessory equipment. There are many types of workover or intervention activities that may be performed using the intervention connector. These may include installation and retrieval of plugs, well logging, perforating, acidizing, tubing gaging, coil tubing work, and the like.

In summary, the bridge assembly is retrievable and replaceable. The intention is to house all the normally retrievable equipment on this assembly. A customer can choose from many different bridge options. Some of these options may include a simple bridge where a flowloop joins the vertical bore to the fiowline. In another embodiment a Bridge Assembly may carry a choke in the loop. Because the bridge is a retrievable assembly, the choke does not need to be the insert-retrievable type. In another embodiment, a Bridge Assembly may include an SCM. Again, these items need not be the retrievable type because they are built into a bridge which itself is retrievable. Other possibilities include a Bridge Assembly with choke, SCM, flowmeters, chemical injection metering valves, processing equipment, sensors, and the like. In yet another embodiment, the replaceable Bridge Assembly provides the operator the opportunity to retrofit existing wells with new/emerging technologies.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF PRESENTLY PREFERRED EMBODIMENTS

Figure 1:
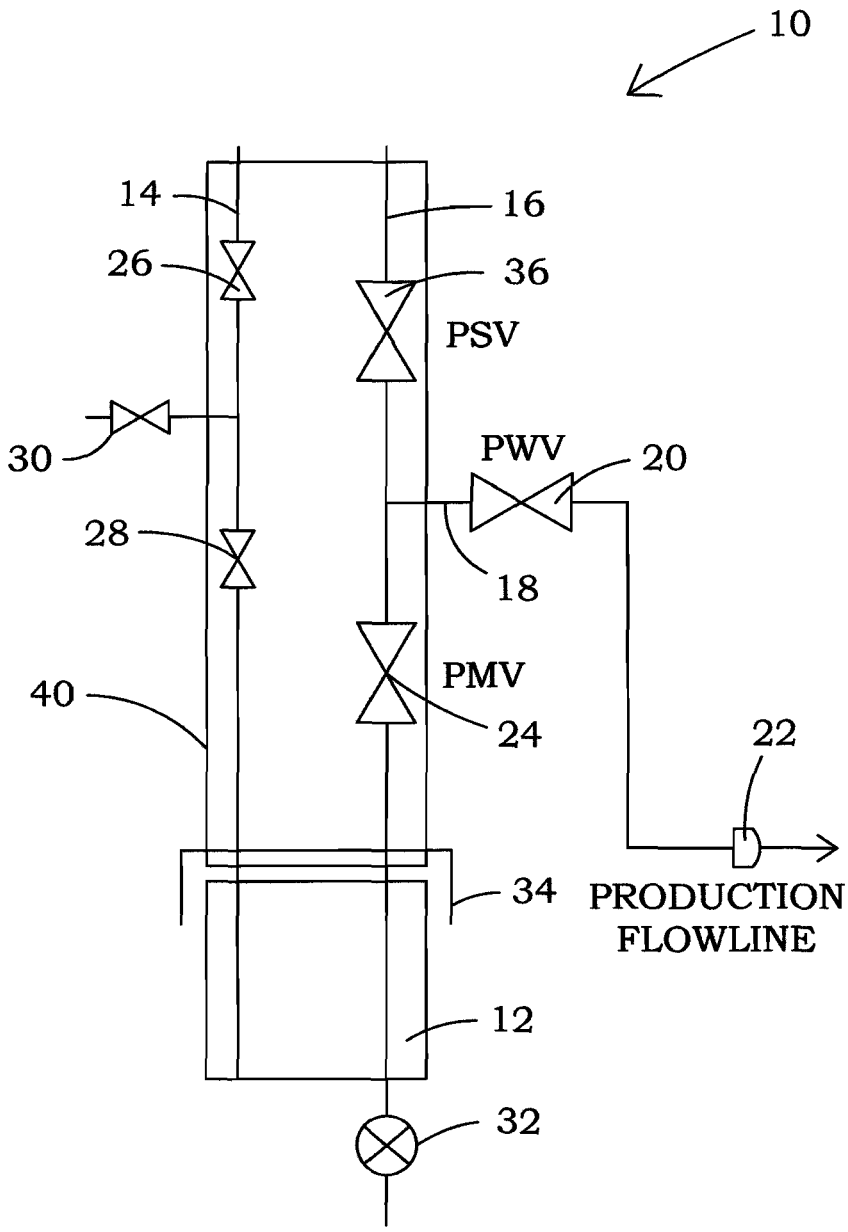
FIG. 1 (PRIOR ART)
FIG. 1 is a schematic view of a conventional subsea tree installed on a wellhead.
Figure 2:
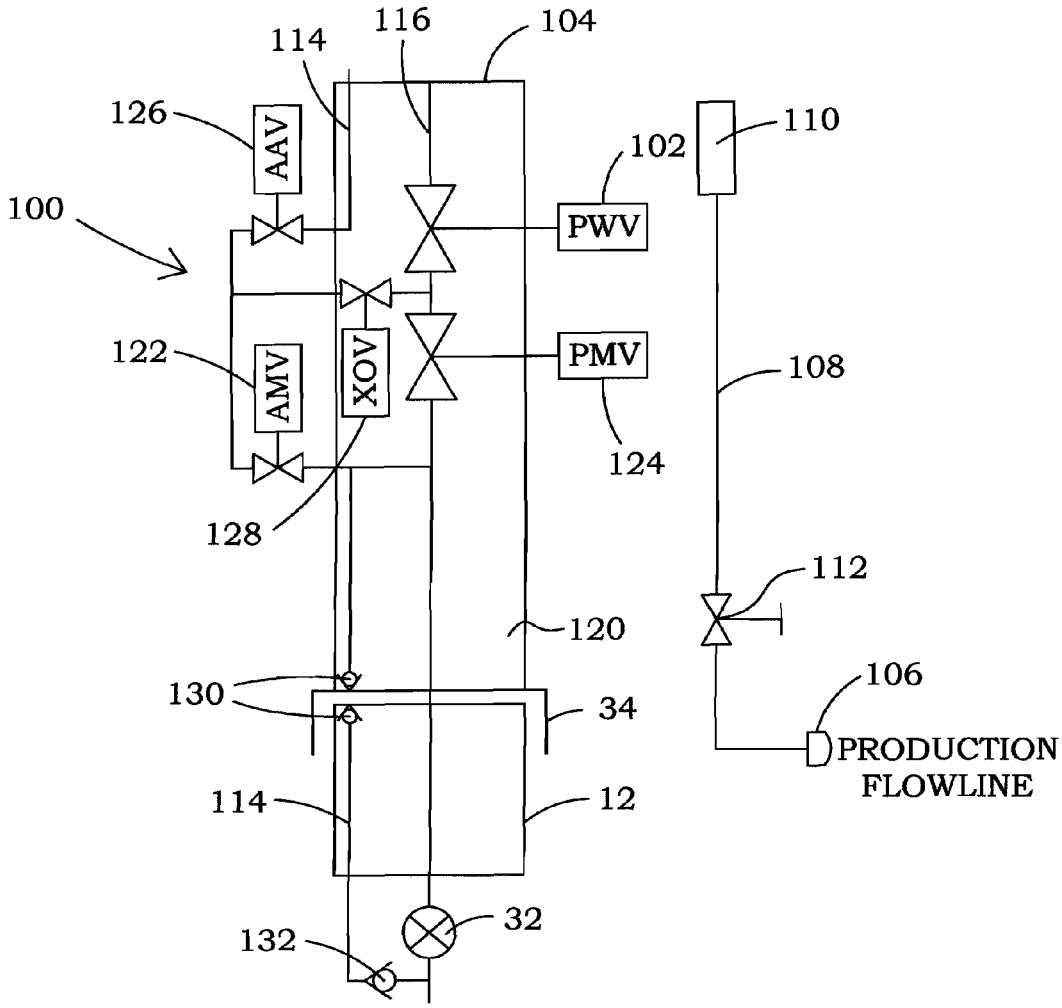
FIG. 2 is a schematic view of a retrievable bridge subsea tree installed on a well without a bridge or after the bridge has been removed in accord with one possible embodiment of the present invention.

FIG. 2 shows one possible schematic view of subsea installation 100 comprising retrievable bridge enabled subsea tree 120 installed on wellhead 12 (without a retrievable bridge or after the retrievable bridge has been removed.) It will be noted that the production wing valve (PWV) 102 now provides a connection to top 104 of subsea tree 120 rather than to the side of the tree as is shown in the prior art subsea shown schematically in FIG. 1. Production flowline 106 is also configured differently, with vertical connection line 108, that preferably rises up to or towards top 104 of production tree mandrel. Flowline connector 110 is oriented for connection from the vertical direction rather than the horizontal direction as shown in FIG. 1. Production flowline valve 112 is preferably provided to close off production flowline 106 when the retrievable bridge is not present. Production master valve 124, annulus master valve 122, annulus access valve 126, crossover valve 128, annulus line 114, and the like are substantially the same as described in prior art tree 10 of FIG. 1. Other valves may also be provided, if desired. If desired, annulus connector 130 may comprise two one-way valves which seal annulus 114 prior to connection but open when connected. If desired, one-way valve may be utilized to provide a well barrier prior for Xmas tree installation, which is then opened/depressed once the Xmas tree is installed, allowing annular access.

A significant difference between subsea tree 120 and the prior art tree of FIG. 1 is the absence of fixed lateral connection 18. Instead, preferably, the only connection between production line 116 and production flowline 106 is provided through a retrievable bridge (not shown in FIG. 2), which is attachable to the top of subsea tree 120, as discussed hereinafter. This subsea tree configuration has advantages in that any high maintenance items, such as chokes, are provided in a readily replaceable bridge. Moreover, in the preferred embodiment, there is no need to make connections with the lateral connection 18 shown in FIG. 18.

Figure 3:
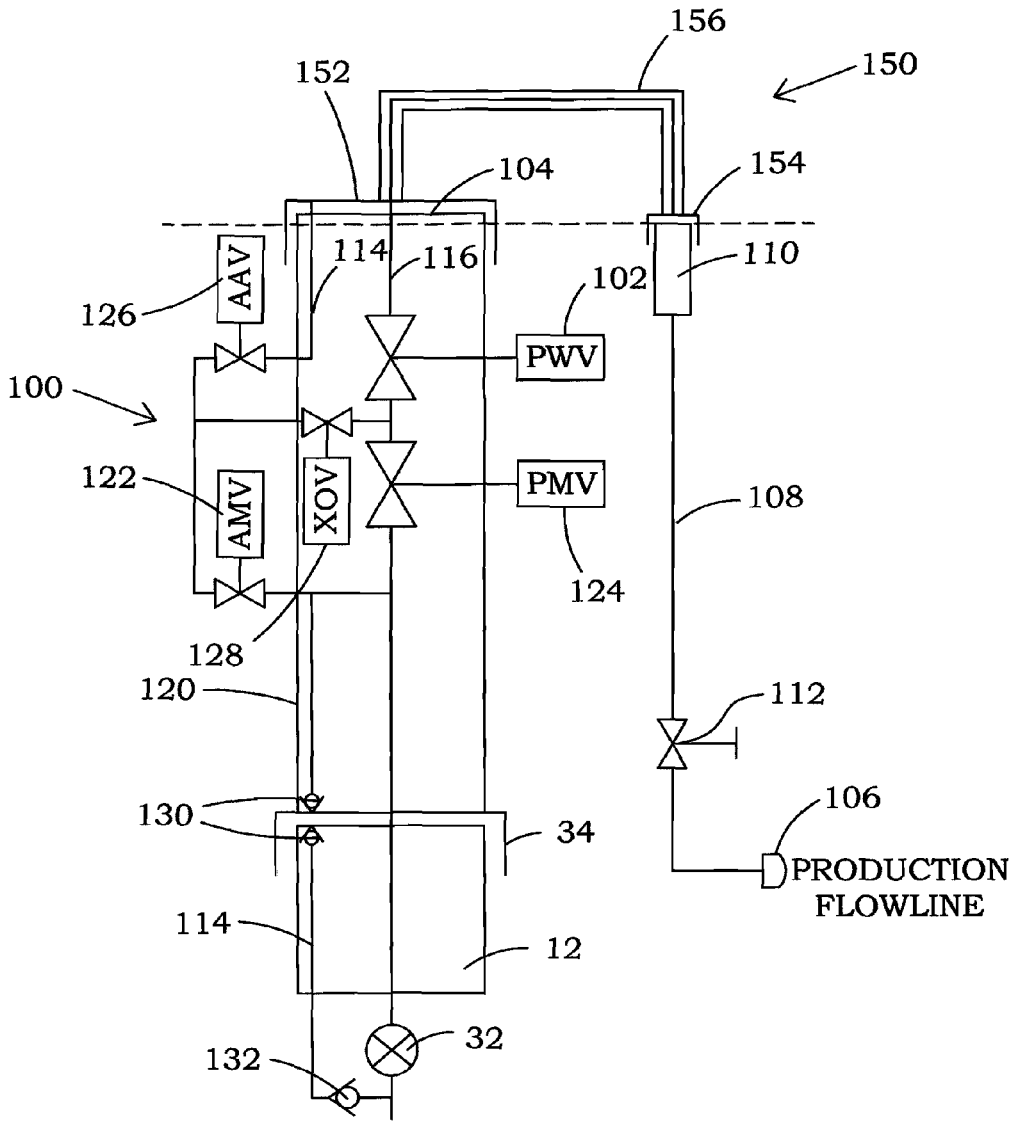
FIG. 3 is a schematic view of a retrievable bridge subsea tree installed on a well with a retrievable bridge installed to the top of the subsea tree or flowline and to the top of a vertical section of the production flowline in accord with one possible embodiment of the present invention.

FIG. 3 shows one possible embodiment of the invention, a schematic of subsea installation 100 with retrievable bridge 150 installed on retrievable bridge enabled subsea tree 120. In this example, a basic retrievable bridge is utilized, without additional possible variations of the invention as discussed hereinafter. In this embodiment, retrievable bridge 150 may comprise two connectors 152 and 154 with flow path 156 to fluidly connect production line 116 with production flowline 106. Connector 152 physically connects to top 104 of retrievable bridge enabled subsea tree 120, which is upwardly or vertically oriented or accessible so that top 104 is accessible utilizing tools, mandrels, pipes, and the like that are introduced from the surface. Thus, connector 152 and a corresponding connector on top 104 are preferably oriented so that vertical movement, or vertically oriented interconnection mechanisms are utilized for making the connection between production line 116 and production flowline 106. Underwater remotely operated vehicles may be utilized for stabbing/making the connections. Connectors 152 and 154 may be hydraulically operated or bolted together using the remotely operated vehicles. The connections may comprise alignment elements and suitable seals.

Thus, it will be appreciated that retrievable bridge 150 may now be lowered from the surface to connect production flowline 106 to production line 116 or disconnected by removing retrievable bridge 150 from the top of subsea tree 120. This novel construction has many advantages over the prior art, some of which are discussed hereinafter.

Figure 4:
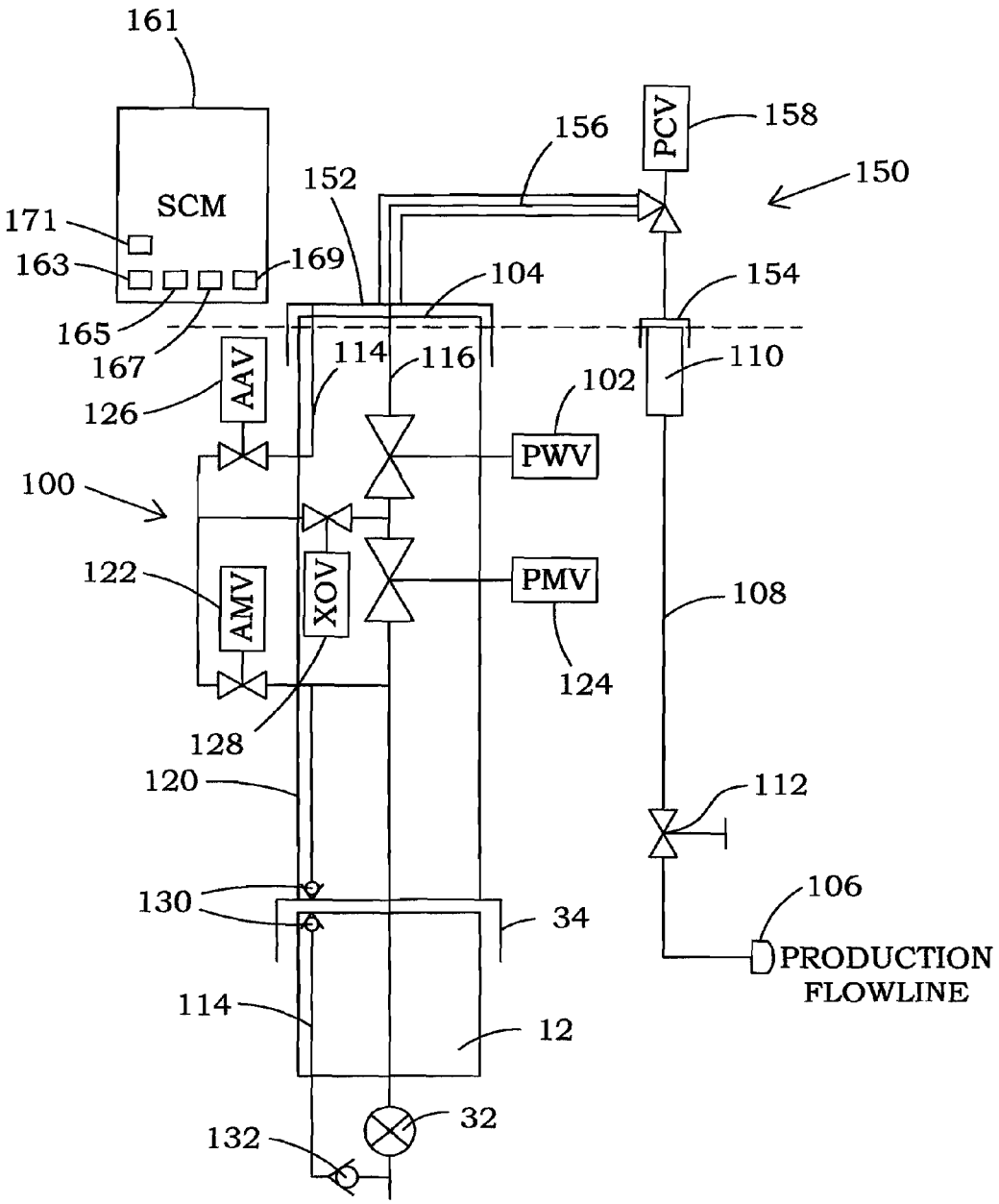
FIG. 4 is a schematic view of a retrievable bridge subsea tree installed on a well with a retrievable bridge installed to the top of the subsea tree or flowline and to the top of a vertical section of the production flowline and including a choke in the fluid flow passageway of the retrievable bridge and further including a subsea control module, both of which are replaceable by replacing the retrievable bridge, in accord with one possible embodiment of the present invention.
Figure 5:
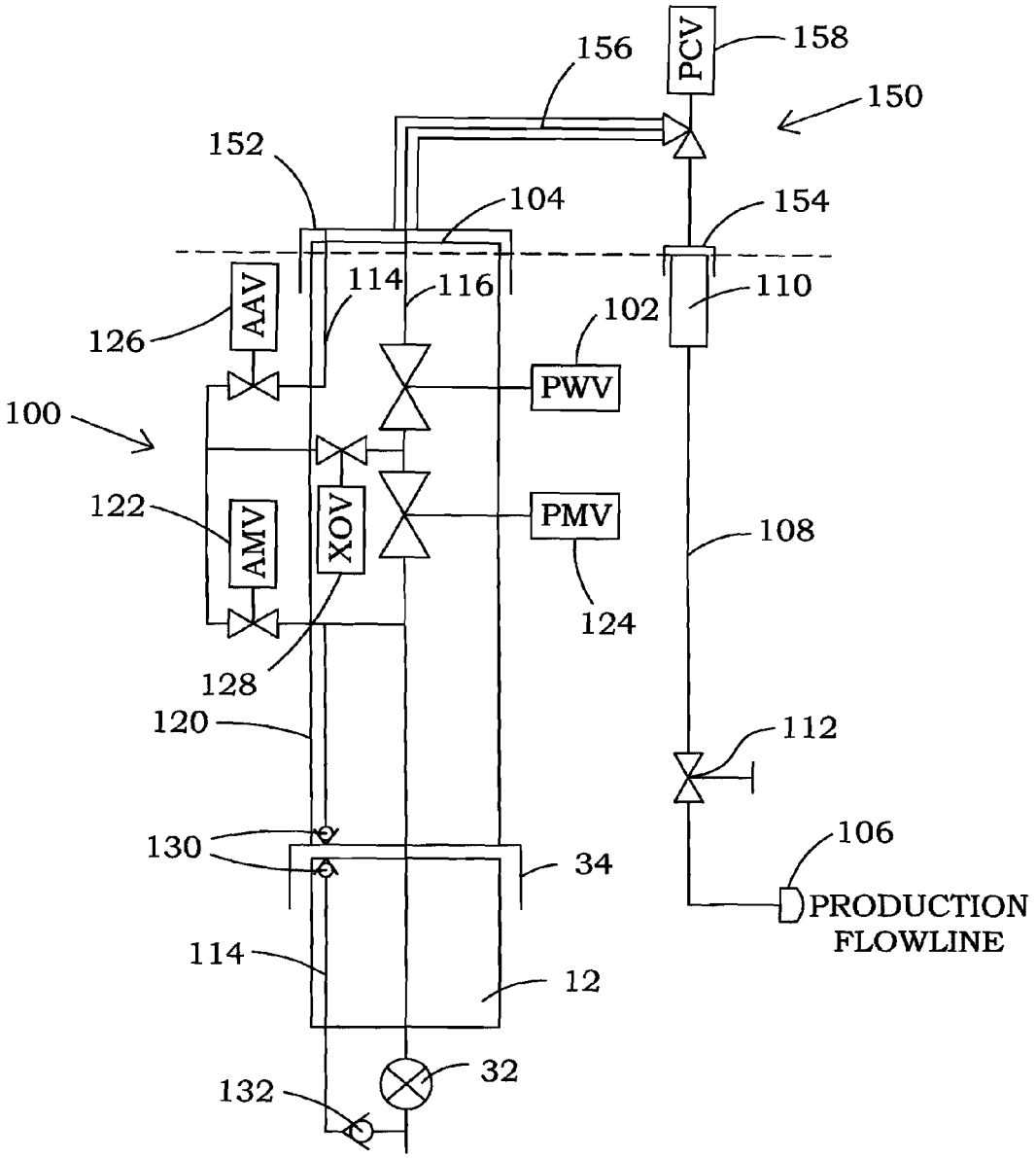
FIG. 5 is a schematic view of a retrievable bridge subsea tree installed on a well with a retrievable bridge installed to the top of the subsea tree or flowline and to the top of a vertical section of the production flowline and including a choke in the fluid flow passageway of the retrievable bridge which is replaceable by replacing the retrievable bridge, in accord with one possible embodiment of the present invention.

FIG. 4 and FIG. 5 show possible embodiments of retrievable bridge 150, which comprise production choke valve 158. Production choke valve 158 may be adjusted or sized to provide the desired flow and back pressure. Production choke valves are a wear items, which are more likely to need replacement than other tree components. In the prior art, replacement of choke valves either requires removal of the entire tree or specially replaceable chokes. The replaceable chokes must be designed with removable seals, that are more costly than standard chokes, and each type of replaceable choke may require special mounting and/or operating procedures.

Thus, in this embodiment of the present invention, less expensive standard chokes may be utilized. As well, there is no need to replace the entire tree. As part of retrievable bridge 150, subsea control module 161, shown in FIG. 4 but absent in FIG. 5, may also be provided. Subsea control modules may comprise electrical sensors 163, hydraulic controls 165, choke adjustment mechanisms 167, sand detection sensors 169, corrosion monitoring sensors 171, and the like. Accordingly, subsea control modules are complex and more likely to need repair or replacement.

While prior art subsea control modules may also be retrievable without removing the subsea tree, they will normally require mountings and connections to be made at subsea depths. In accord with the present invention, subsea control module 161 is effectively retrievable but can be built into retrievable bridge 150, which includes the connection to production flowline 106, thereby providing more reliable electrical and physical connections to the subsea tree and production line 116 and annulus line 114 than has been available in the prior art retrievable subsea control modules. Thus, operation, reliability, and maintenance of the subsea control module is enhanced when used with retrievable bridge 150 in accord with the present invention.

Figure 6:
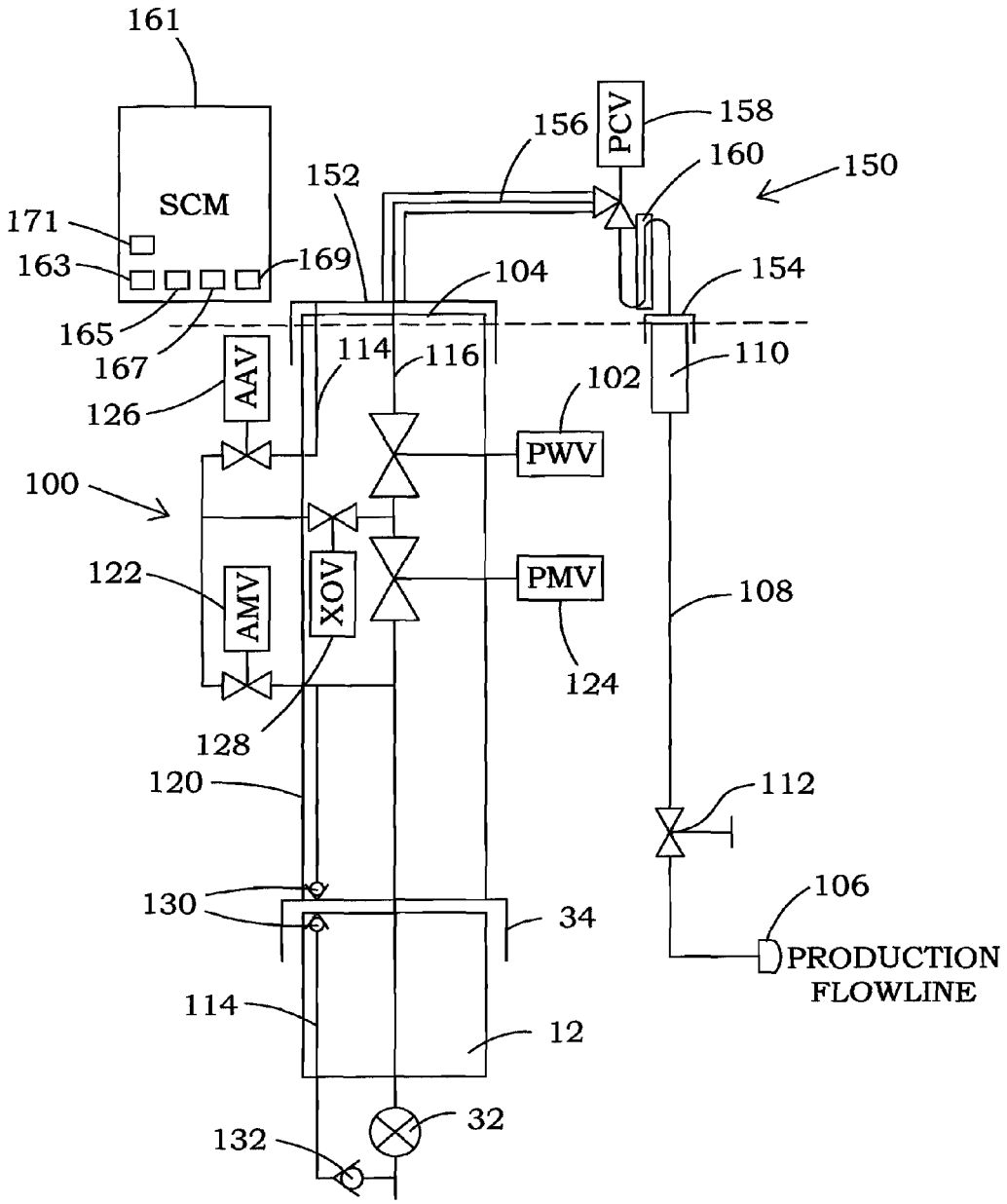
FIG. 6 is a schematic view of a retrievable bridge subsea tree installed on a well with a retrievable bridge installed to the tops of the subsea tree or flowline and to the top of a vertical section of the production flowline and including a flowmeter in the fluid flow passageway of the retrievable bridge, a choke, and further including a subsea control module, all of which are replaceable by replacing the retrievable bridge, in accord with one possible embodiment of the present invention.
Figure 7:
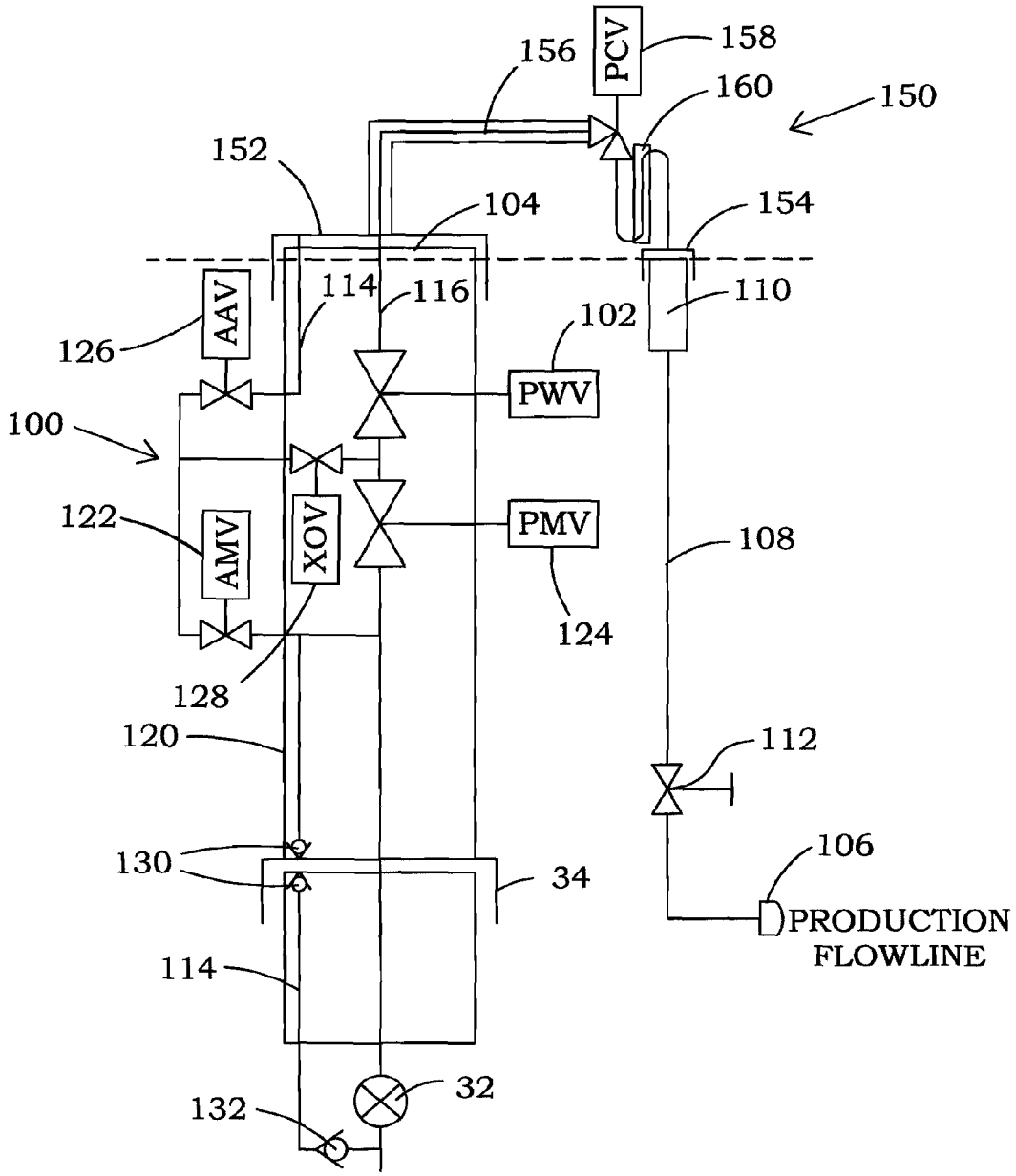
FIG. 7 is a schematic view of a retrievable bridge subsea tree installed on a well with a retrievable bridge installed to the tops of the subsea tree or flowline and to the top of a vertical section of the production flowline and including a flowmeter in the fluid flow passageway of the retrievable bridge and further including a choke, both of which are replaceable by replacing the retrievable bridge, in accord with one possible embodiment of the present invention.

FIG. 6 and FIG. 7 shows retrievable bridge 150 utilizing choke 158 and flow meter 160. FIG. 6 further comprises preferably built-in subsea control module 161. In the embodiment of FIG. 6, subsea control module 161 may be designed utilize flow meter 160 and/or pressure sensors for adjusting choke 158 and/or the back pressure as needed. These devices can be built into retrievable bridge 150 to measure flow rates along fluid flow path 156. Because these items can be built into flow path 156 of retrievable bridge 150 at the surface they are more reliable than items that must be installed under subsea conditions, and yet also easier to maintain due to the relative ease with which retrievable bridge is recovered and/or replaced. Moreover, when conditions of the well require changes to the equipment, as discussed above, such items can be more readily changed out.

Figure 8:
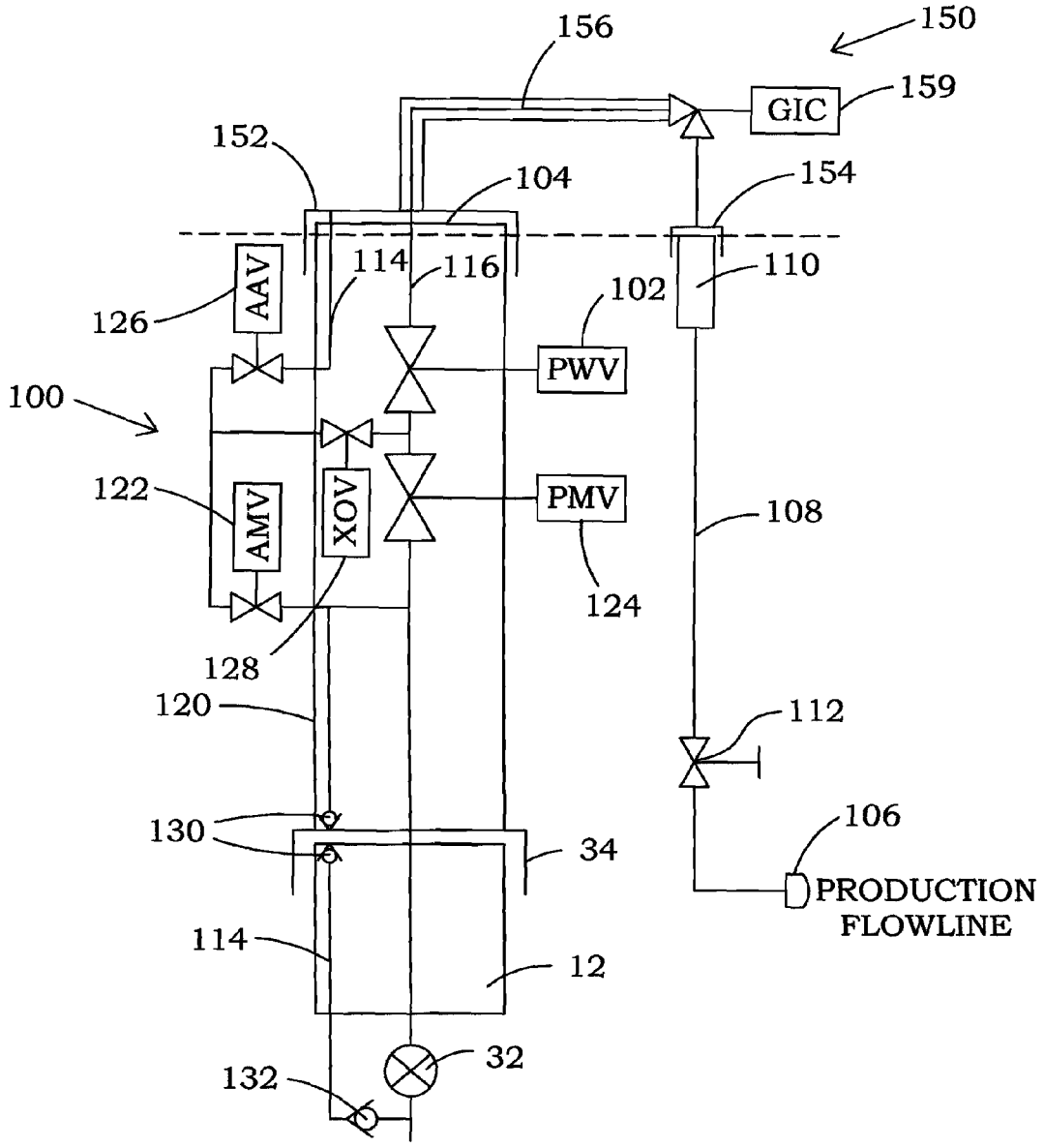
FIG. 8 is a schematic view of a retrievable bridge subsea tree installed on a well with a retrievable bridge installed to the tops of the subsea tree or flowline and to the top of a vertical section of the production flowline and including a choke reversed for gas injection in the fluid flow passageway of the retrievable bridge, which is replaceable by replacing the retrievable bridge, in accord with one possible embodiment of the present invention.

FIG. 8 shows another embodiment of retrievable bridge 150 wherein gas injection choke 159 may be utilized. Gas injection choke is reversed in direction from production control choke 158, discussed hereinbefore. If production declines, then it may be desired to change out the configuration of the subsea tree to provide for injection of gas or other fluids such as liquids. These changes are relatively quickly and easily accomplished by retrieving and/or replacing retrievable bridge 150 in accord with the present invention as compared with replacing the entire subsea tree.

Figure 9:
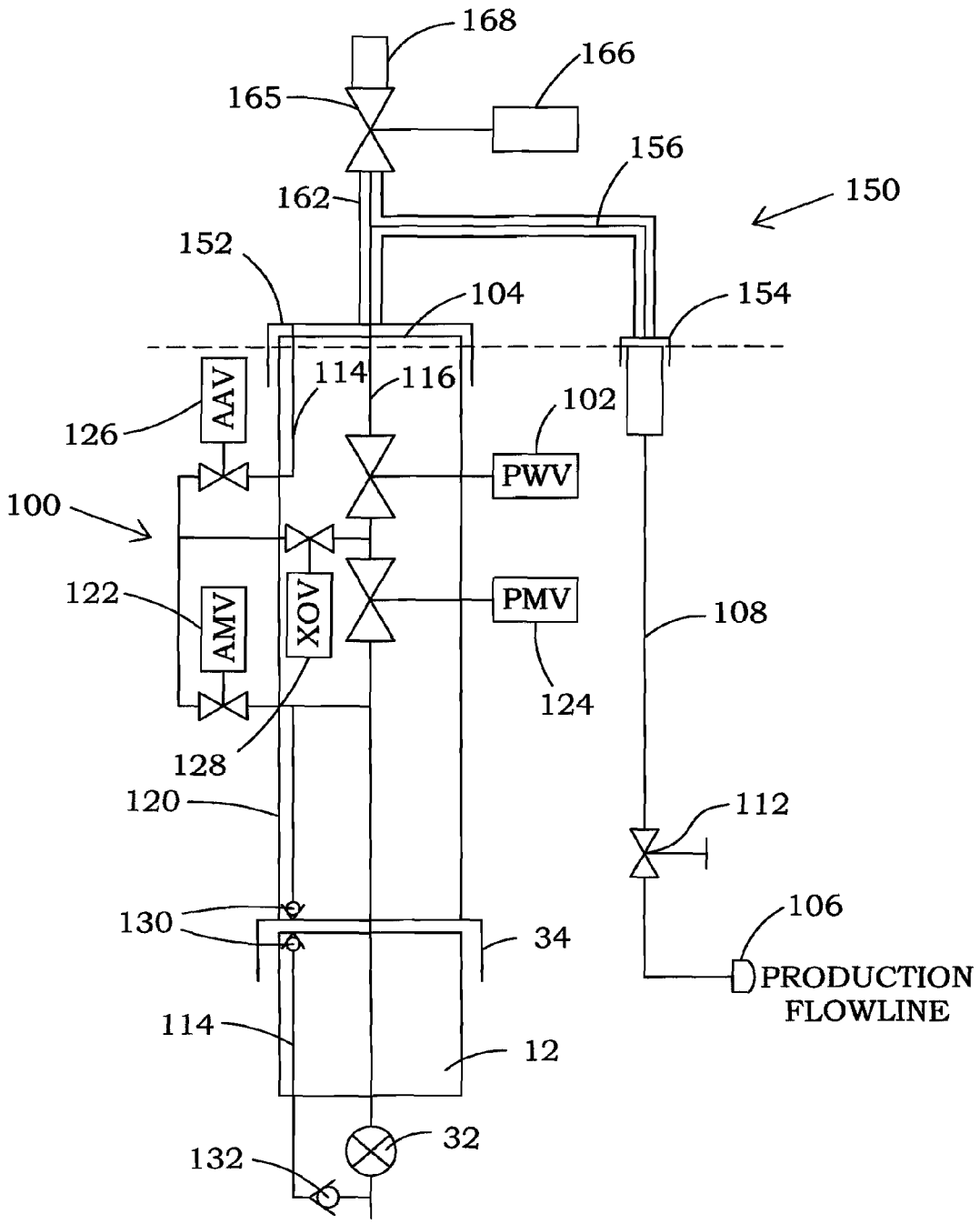
FIG. 9 is a schematic view of an intervention connector with a crown valve being secured to the replaceable bridge to permit entry into the subsea tree through the retrievable bridge in accord with one possible embodiment of the present invention.

FIG. 9 shows another embodiment of the invention, whereby intervention into well 12 is possible without removing retrievable bridge 150. In the previous examples, bridge 150 must be removed before intervention or access into well 12 or subsea tree 120 is possible. However, it may be desired to access the well 12 without first removing retrievable bridge 150. Accordingly, in this embodiment, an intervention method through the replaceable bridge is provided. In this embodiment, upwardly directed or vertical pipe extension 162 may be provided along with a vertically oriented bore of crown valve 160, to allow access through retrievable bridge 150. Crown valve 160 is controlled with operator 165, which may be hydraulic or manual.

Mandrel 166 may be provided above crown valve 166, which may provide a convenient connection for to an intervention package (not shown). Mandrel 166 can essentially be a guide element, to which a connection is readily made utilizing a mating element.

Figure 10:
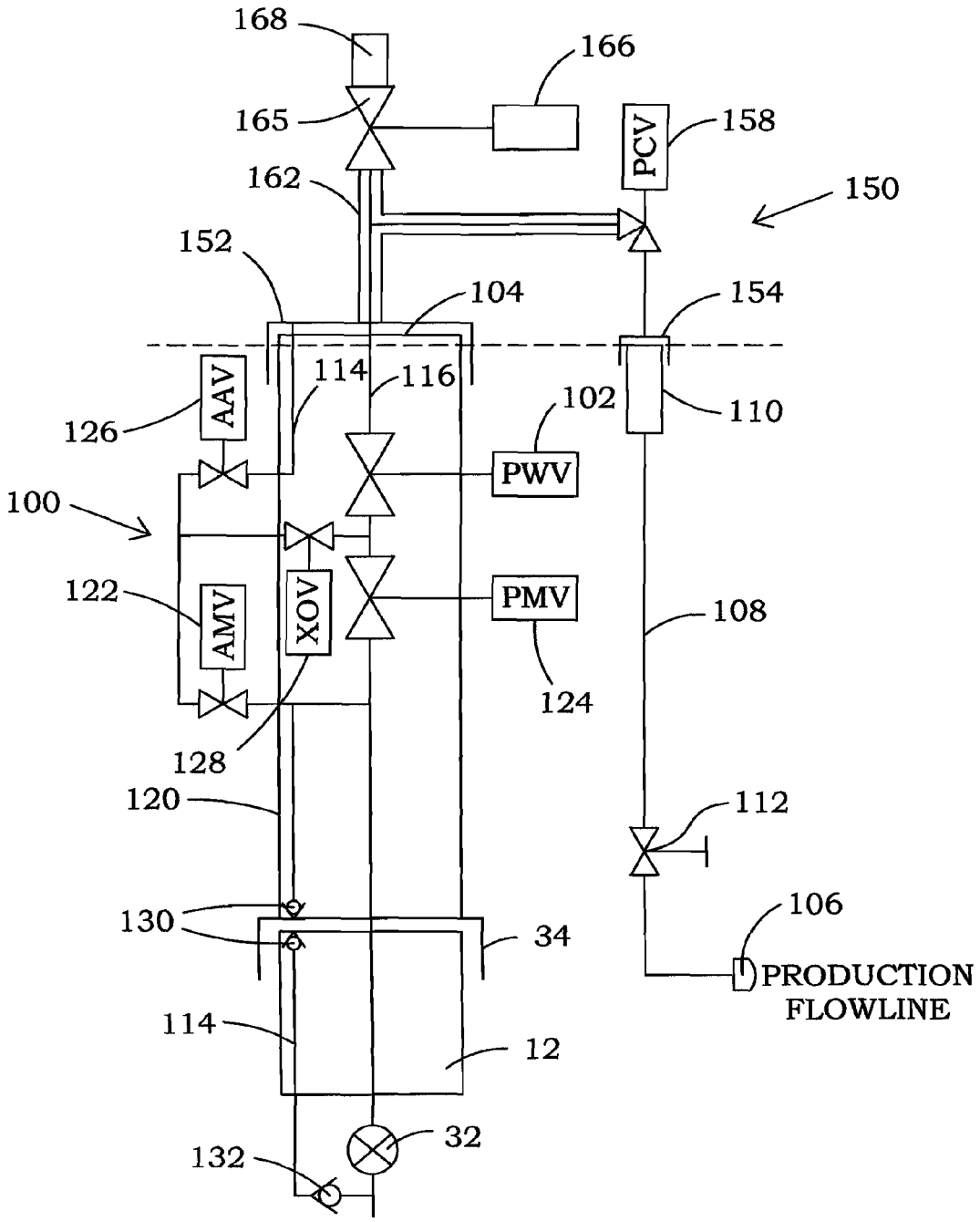
FIG. 10 is a schematic view of an intervention connector with a crown valve being secured to the retrievable bridge to permit entry into the subsea tree through the replaceable bridge wherein the retrievable bridge includes a choke in the fluid flow passageway of the retrievable bridge in accord with one possible embodiment of the present invention.
Figure 11:
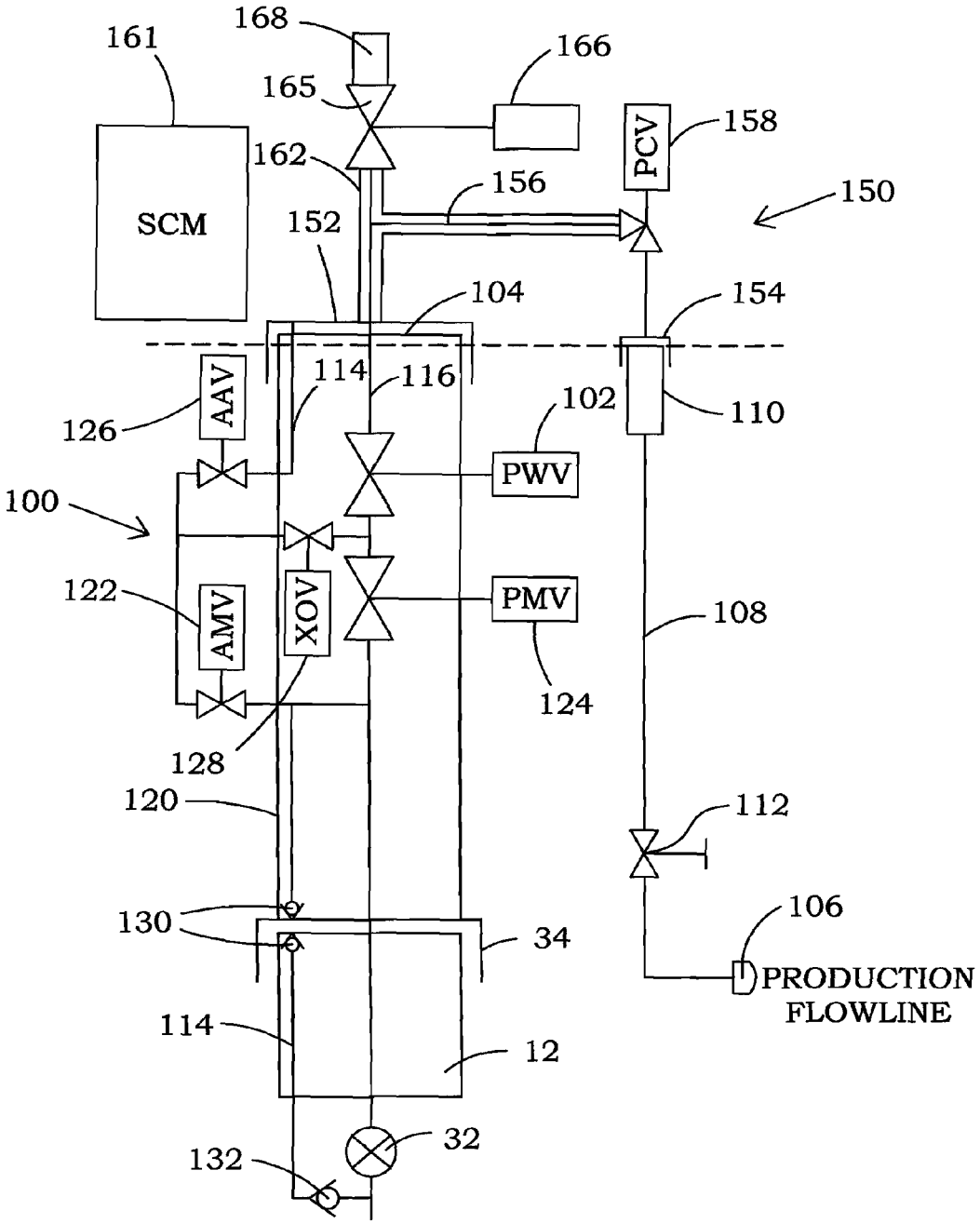
FIG. 11 is a schematic view of an intervention connector with a crown valve being secured to the retrievable bridge to permit entry into the subsea tree through the replaceable bridge wherein the retrievable bridge includes a choke in the fluid flow passageway of the retrievable bridge and further including a subsea control module in accord with one possible embodiment of the present invention.
Figure 12:
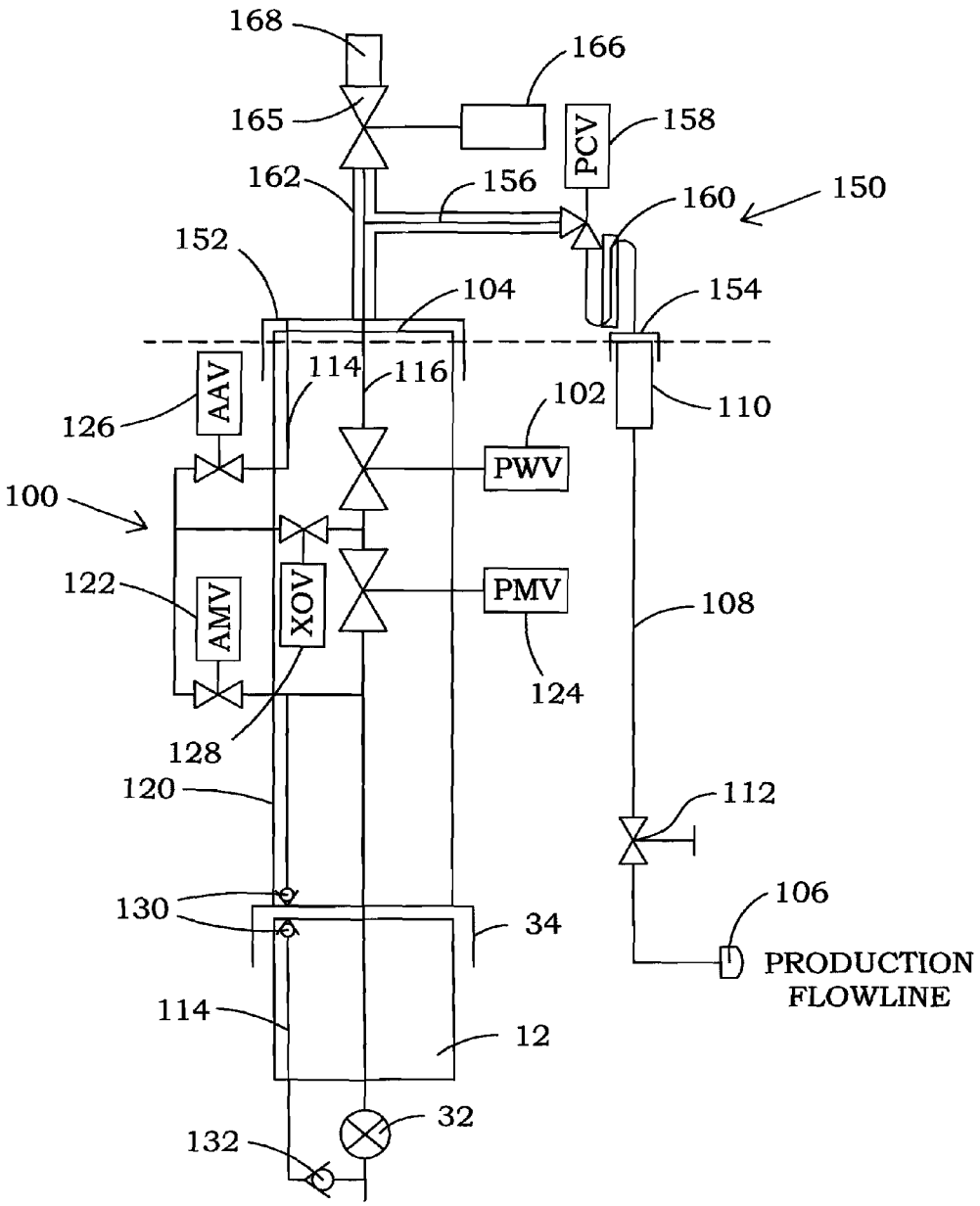
FIG. 12 is a schematic view of an intervention connector with a crown valve being secured to the retrievable bridge to permit entry into the subsea tree through the replaceable bridge wherein the retrievable bridge includes a flowmeter in the fluid flow passageway of the retrievable bridge and a choke in accord with one possible embodiment of the present invention.
Figure 13:
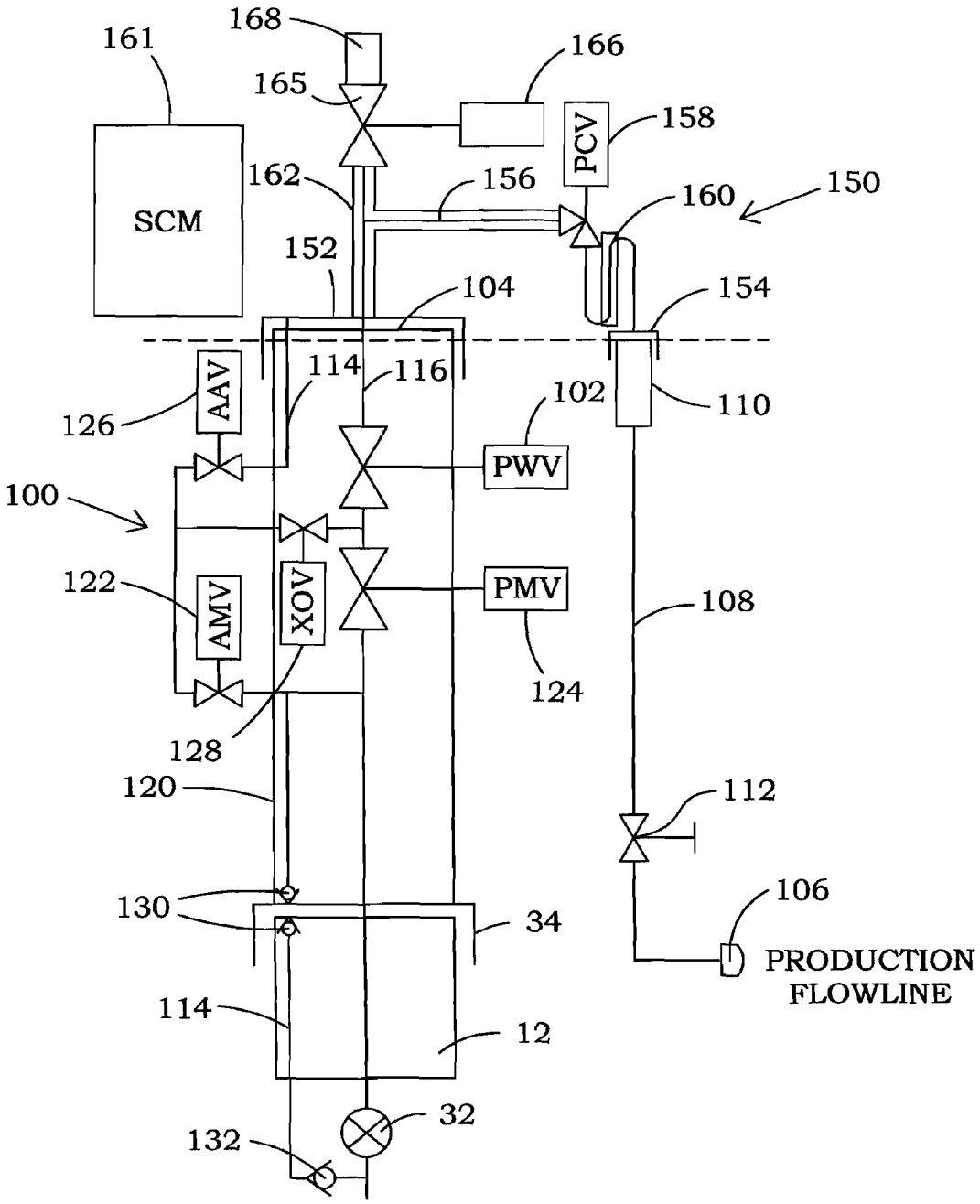
FIG. 13 is a schematic view of an intervention connector with a crown valve being secured to the retrievable bridge to permit entry into the subsea tree through the replaceable bridge wherein the retrievable bridge includes a flowmeter in the fluid flow passageway of the retrievable bridge, a choke, and further including a subsea control module, all of which are replaceable by replacing the retrievable bridge, in accord with one possible embodiment of the present invention.
Figure 14:
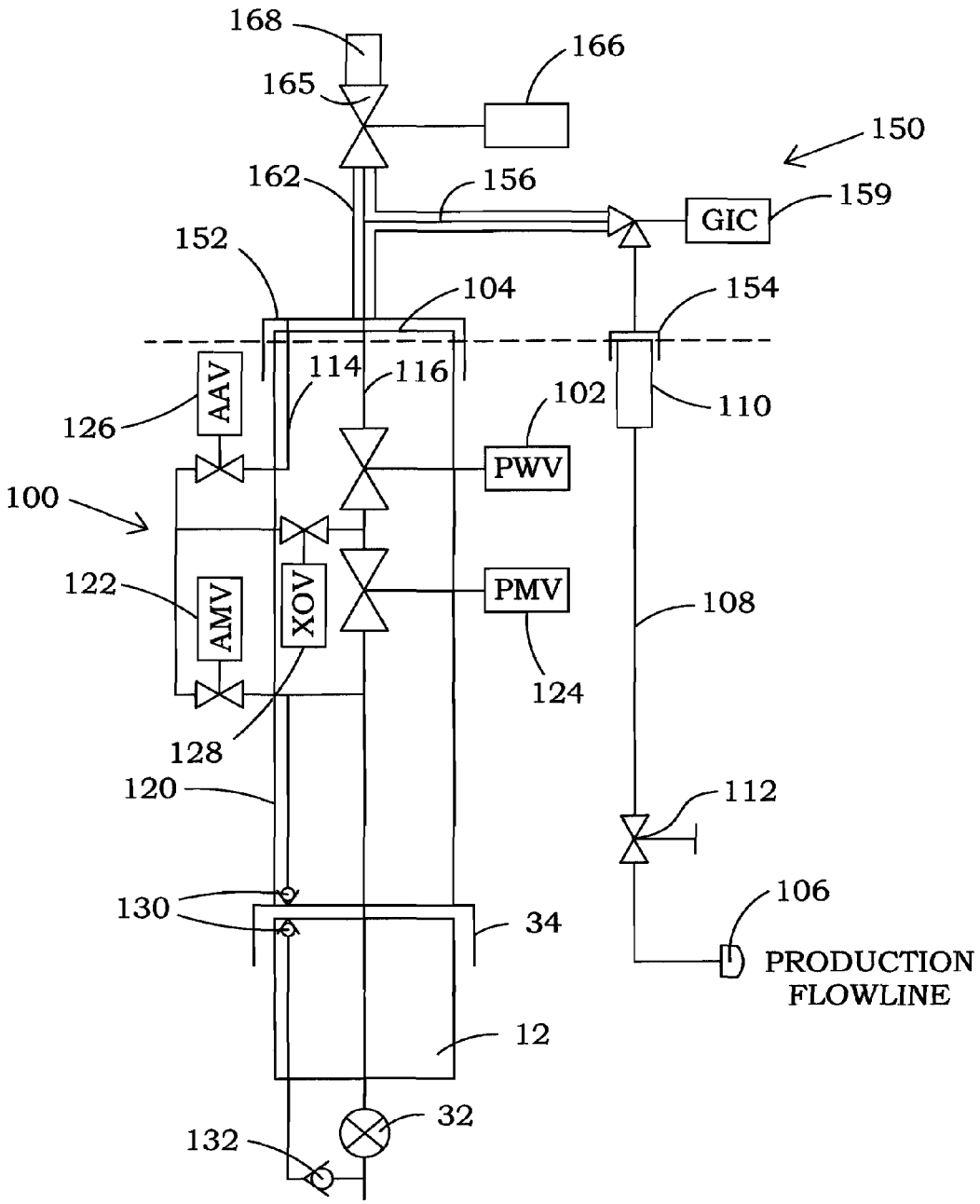
FIG. 14 is a schematic view of an intervention connector with a crown valve being secured to the retrievable bridge to permit entry into the subsea tree through the replaceable bridge wherein the retrievable bridge includes a choke reversed for gas injection in the fluid flow passageway of the retrievable bridge, which is replaceable by replacing the retrievable bridge, in accord with one possible embodiment of the present invention.

It will be understood that although retrievable bridge 150 of FIG. 9 does not show other elements besides flow path 156, that other embodiments thereof may comprise other components such as chokes, subsea control modules, flow meters, and/or other devices as well as access means 166. Various possible examples are shown in FIG. 10, FIG. 11, FIG. 12, FIG. 13, and FIG. 14. In FIG. 10, production choke valve 158 is utilized. In FIG. 11, subsea control module 161 is added to this configuration. In FIG. 12, flow meter 160 is built into retrievable bridge 150. In FIG. 13, retrievable bridge 150 comprises production choke valve 158, flow meter 160, and subsea control module 161. In FIG. 14, retrievable bridge 150 comprises gas injection choke 159 Accordingly, the above and other configurations of elements may be utilized with retrievable bridge 150.

In operation of retrievable bridge subsea tree 120 and retrievable bridge 150, as shown in FIGS. 2-8, retrievable bridge subsea tree 120 is installed on well head 12. Thus, valves in the well are closed, such as valve 32. The various annulus and production line valves are also closed. Retrievable bridge 150 is then lowered from the surface, and connections 152 and 154 are made up and/or hydraulically activated. Then production master valve 124, production wing valve 102, and production flowline valve 112 are opened to allow flow from production line 116 of well 12 to production flowline 106. Retrievable bridge 150 is removed by the opposite procedure, namely closing the various valves, releasing connections 152 and 154, and then vertically raising retrievable bridge 150 to the surface.

In order to access the well utilizing retrievable bridge 150 with intervention mandrel 166 after retrievable bridge 150 is installed as discussed above, the method may comprise steps such as running an intervention package for connecting to retrievable bridge 150 via an intervention connector at the top of mandrel 166, discussed hereinbefore. The intervention connector may be a pin or box type connector. Crown valve 160 between the connector and the bridge, is initially closed for pressure control. After the intervention package is connected, then crown valve 160 on the intervention connector is opened utilizing operator 165 whereupon workover or intervention activities can proceed into well 12 through the mandrel 166 and retrievable bridge 150 (and the intervention package). The intervention connector of mandrel 166 allows make up to any intervention tooling or equipment for the purposes of running some equipment into the well, via retrievable bridge 150 and subsea tree 120.

Thus, crown valve 160 in the intervention connector provides pressure control for retrievable bridge 150 when access is not required and is opened for access to subsea tree 120 and well 12. After the intervention activity, the crown valve is closed again before removal of the intervention package or other accessory equipment from mandrel 166 but after any tools have been removed from the bore of crown valve 160. There are many types of workover or intervention activities that may be performed using the intervention connector. These may include installation and retrieval of plugs, well logging, perforating, acidizing, tubing gaging, coil tubing work, and the like.

Accordingly, the foregoing disclosure and description of the invention is illustrative and explanatory thereof, and it will be appreciated by those skilled in the art, that various changes in the ordering of steps, ranges, and/or attributes and parameters, as well as in the details of the illustrations or combinations of features of the software methods and apparatus discussed herein, may be made without departing from the spirit of the invention.

What is claimed is:

1. A subsea tree assembly mountable adjacent to a subsea production flowline, comprising:

a subsea tree with a production line therein, said subsea tree comprising an upper end;

a retrievable bridge comprising a production line connector and a production flowline connector operable for connection and fluid communication with said upper end of said subsea tree and with an upwardly directed end of said production flow line, respectfully, said retrievable bridge defining a fluid flow passageway therein, whereby said production line of said subsea tree is in fluid communication with said production flowline only through said retrievable bridge and only after said retrievable bridge is connected to said subsea tree and said production flowline;

an annulus connection between said retrievable bridge and an annulus line of said subsea tree, said annulus connection being the only annulus line fluid connection between said retrievable bridge and said annulus line of said subsea tree, and an annulus access valve for access to said annulus line located in said subsea tree, an annulus master valve for said annulus line located in said subsea tree, and an annulus line to production line crossover valve located in said subsea tree to provide a valve between said annulus line and said subsea tree production line within said subsea tree.

2. The subsea tree assembly of claim 1, further comprising an intervention access passageway and an intervention package connection at an upper end thereof operable for connection to an intervention package.

3. The subsea tree assembly of claim 2, further comprising a valve within said intervention access passageway.

4. The subsea tree assembly of claim 1 wherein said retrievable bridge defines therein a choke within said fluid flow passageway.

5. The subsea tree assembly of claim 1 wherein said retrievable bridge comprises a subsea control module, said subsea control module comprising a plurality of electronic sensors.

6. The subsea tree assembly of claim 1 wherein said retrievable bridge comprises a flowmeter.

7. The subsea tree assembly of claim 1 wherein said retrievable bridge comprises an injection choke.

8. A retrievable bridge to provide the only fluid communication available between a subsea installation comprising a subsea tree and a production flowline, said retrievable bridge comprising:

a first connector for connecting to said subsea tree installation and a second connector for connecting to said production flowline, said retrievable bridge, when installed, defining a fluid flow passageway which connects between said subsea tree and said production flowline; and an intervention access passageway and an intervention package connection positioned at an upper end of said retrievable bridge operable for connection to an intervention package.

9. The retrievable bridge of claim 8 further comprising a valve within said intervention access passageway.

10. The retrievable bridge of claim 8 wherein said retrievable bridge defines therein a choke within said fluid flow passageway.

11. The retrievable bridge of claim 8 wherein said retrievable bridge comprises a subsea control module, said subsea control module comprising a plurality of electronic sensors.

12. The retrievable bridge of claim 8 wherein said retrievable bridge comprises a flowmeter.

13. The retrievable bridge of claim 8 wherein said retrievable bridge comprises an injection choke.

14. A retrievable bridge for fluidly connecting between a production line in a subsea tree and a production flowline, said subsea tree and said retrievable bridge comprising:

at least two connectors in said retrievable bridge for connecting to said production line in a top of said subsea tree and an upwardly extending top of said production flowline, said retrievable bridge, when installed, defining a fluid flow passageway which connects between said production line and said production flowline, and a choke to control fluid flow through said fluid flow passageway;

an annulus connection between said retrievable bridge and an annulus line of said subsea tree, said annulus connection being the only annulus line fluid connection between said retrievable bridge and said annulus line of said subsea tree, and an annulus access valve for access to said annulus line located in said subsea tree, an annulus master valve for said annulus line located in said subsea tree, and an annulus line to production line crossover valve located in said subsea tree to provide a valve between said annulus line and said subsea tree production line within said subsea tree.

15. The retrievable bridge of claim 14 further comprising a subsea control module comprising electronic sensors.

16. The retrievable bridge of claim 14 further comprising a flow meter.

17. The retrievable bridge of claim 14 further comprising an intervention access passageway and an intervention package connection positioned at an upper end of said retrievable bridge operable for connection to an intervention package.

18. The subsea tree assembly of claim 17 further comprising a valve within said intervention access passageway.

* * * * *